US005548257A

United States Patent [19]

Caplan et al.

[11] Patent Number: 5,548,257

[45] Date of Patent: Aug. 20, 1996

[54] VACUUM-BARRIER WINDOW FOR WIDE-BANDWIDTH HIGH-POWER MICROWAVE TRANSMISSION

[75] Inventors: Malcolm Caplan, Fremont; Clifford C. Shang, Tracy, both of Calif.

[73] Assignee: The Regents of the University of California, Oakland, Calif.

[21] Appl. No.: 529,797

[22] Filed: Sep. 18, 1995

[51] Int. Cl.[6] ..... H01P 1/08; H01Q 13/00

[52] U.S. Cl. ..... 333/252; 29/600

[58] Field of Search ..... 333/252; 29/600

[56] References Cited

U.S. PATENT DOCUMENTS

| | | | |
|---|---|---|---|
| 2,990,526 | 6/1961 | Shelton, Jr. | 333/252 |
| 4,371,854 | 2/1983 | Cohn et al. | 333/252 |
| 5,313,179 | 5/1994 | Moeller | 333/252 |
| 5,400,004 | 3/1995 | Moeller | 333/252 |

OTHER PUBLICATIONS

S. D. Nelson, et al., "Electromagnetic and Thermal Analysis of Distributed Cooled High Power Millimeter Wave Windows," Lawrence Livermore National Laboratory Report UCRL–JC–119969, May 12, 1995, Lawrence Livermore National Laboratory, Livermore, CA 94550.

C. C. Chang, et al., "Electrical Analysis of Wideband and Distributed Windows Using Time–Dependent Field Codes," Paper prepared for submission to the International Conference on Infrared and mm–waves, Essex, England, Sep. 1993.

J. Y. L. Ma and L. C. Robinson, "Night moth eye window for the millimetre and submillimetre wave region," Optica Acta, 1983, vol. 30, No. 12, pp. 1685–1695.

M. I. Petelin and W. Kasparek, "Surface corrugation for broadband matching of windows in powerful microwave generators," Int. J. Electronics, 1991, vol. 71, No. 5, pp. 871–873.

*Primary Examiner*—Paul Gensler

*Attorney, Agent, or Firm*—Henry P. Sartorio; Richard B. Main

[57] ABSTRACT

A vacuum output window comprises a planar dielectric material with identical systems of parallel ridges and valleys formed in opposite surfaces. The valleys in each surface neck together along parallel lines in the bulk of the dielectric. Liquid-coolant conduits are disposed linearly along such lines of necking and have water or even liquid nitrogen pumped through to remove heat. The dielectric material can be alumina, or its crystalline form, sapphire. The electric-field of a broadband incident megawatt millimeter-wave radio frequency energy is oriented perpendicular to the system of ridges and valleys. The ridges, about one wavelength tall and with a period of about one wavelength, focus the incident energy through in ribbons that squeeze between the liquid-coolant conduits without significant losses over very broad bands of the radio spectrum. In an alternative embodiment, the liquid-coolant conduits are encased in metal within the bulk of the dielectric.

8 Claims, 3 Drawing Sheets

VACUUM-BARRIER WINDOW FOR WIDE-BANDWIDTH HIGH-POWER MICROWAVE TRANSMISSION

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to microwave equipment and methods and more particularly to megawatt average power level microwave sources and waveguides that use windows to pass through microwave energy and that contain vacuums.

2. Description of Related Art

Gyrotrons and free-electron masers are electron-beam driven microwave sources for generating high intensity coherent electromagnetic radiation in the 30–300 gigahertz (Ghz) frequency range. Such microwave radiation assumes many of the characteristics of light, e.g., the ability to be focused, reflected, and diffracted. Such free-electron devices require microwave-transparent windows that can contain their vacuum envelopes against the atmosphere.

A broadband waveguide output window for a tunable low-power gyrotron in the millimeter and sub-millimeter wave region is described by J. Y. L. Ma, et al., in "Night moth eye window for millimetre and sub-millimetre wave region", Optica Acta, 1983 Vol. 130, pp. 1685–1695. Very thin mica windows in output waveguides can pass wide bandwidth energies, but the large cross section is very fragile. Unfortunately, these windows cannot handle high average power.

Nature has provided the night moth with a cornea in the eye that presents an array of cones that project from a surface. Such cones represent a way of achieving broadband anti-reflection, which is all good and well at optical frequencies. At microwave frequencies, certain problems in construction exist. J. Y. L. Ma, et al., proposed a gyrotron output window to separate vacuum from the outside world. They identified that such windows need to comprise a dielectric material that is mechanically strong and that has an appropriate absorption coefficient, e.g., fused quartz with a moth eye structure. Unfortunately, such structures cannot be used at high powers, because the cone tips overheat and cannot rid themselves of heat. The dielectric material itself is not an efficient heat conductor, and the only heat sink is at the edges of the window.

Grooved, or corrugated, surfaces for microwave generator windows were proposed by M. I. Petelin, et al., in "Surface corrugation for broadband matching of windows in powerful microwave generators", Int. J. Electronics, 1991, No. 5, pp. 871–873. Wave reflection in monochromatic sources is usually said to be eliminated by using a single edge-cooled disc that has a thickness of some multiple of the half-wavelength in the dielectric or by using a double disc with surface cooling where the gap between the discs forms a symmetric resonator at the monochromatic frequency. Broadband radiation is more a problem. Windows with surfaces shaped with periodic sequences of pyramids were dropped in favor of grooving the window surfaces, e.g., for simplicity in fabrication. Such grooving is shown for one surface only. The electric field of the incident polarized radiation is set perpendicular to the grooves for maximum effect. Experiments and computations conducted at Lawrence Livermore National Laboratory indicate that the relevant phenomenon do not manifest exactly as M. I. Petelin, et al., had theorized. It has been observed that incident radiation at microwave frequencies tends to diffract and bunch up into paths as it passes through the dielectric, e.g., with the highest energy banded into paths aligned with the crests of the grooves rather that the troughs. The grooved windows proposed by M. I. Petelin, et al., are not suitable for use at high powers, e.g., a megawatt; because the edge cooling or surface cooling cannot keep up with the heat dumped into the window.

The present inventors commented on the problem of barrier windows for vacuum envelopes in microwave tubes operated at high average power, especially at millimeter wavelengths. See, C. C. Shang and M. Caplan, "Electrical Analysis of Wideband and Distributed Windows Using Time-Dependent Field Codes", International Conference on Infrared and mm-waves, Essex, England, UK, Sept. 1993. Such windows experience severe thermal and mechanical stresses when operated at over the hundreds of kilowatts level. Grooved windows with grooved periods of $\lambda/3$ (at 140 Ghz) and groove depths of $\lambda$ were investigated. The corrugations were found to focus the radio frequency (RF) energy into the bulk dielectric portion of the window. See, FIG. 3 of the cite.

In U.S. Pat. No. 5,313,179, Charles Moeller describes a distributed microwave window that couples microwave power in the $HE_{11}$ mode between two large diameter waveguides. The window provides a physical barrier between the two waveguides, e.g., without the need for any transitions to other shapes or diameters. The window comprises a stack of alternating dielectric and hollow metallic strips, brazed together to form a vacuum barrier. The metallic strips are tapered on both sides of the vacuum barrier to funnel the incident microwave power through the dielectric strips. The vacuum barrier is either normal to or tilted with respect to the waveguide axis. The wall of parallel strips are set perpendicular to the transverse electric field of the incident microwave power. A coolant is pumped through the metallic strips.

In a later U.S. Pat. No. 5,400,004, Charles Moeller further described corrugating the dielectric strips fronting the microwave power to reduce losses. FIGS. 7–9 of '004 show corrugations 60 comprised of ridges 62 that are very fine features that run parallel to the incident E-field. Such corrugations are said to function as alternating strips of air and dielectric and provide an effective dielectric constant that minimizes ohmic and dielectric losses associated with passage of microwave power through the window. The corrugated edges act as matching sections which reduce the internal standing wave and thus are said to reduce the internal stored energy and dissipation. Each of the metallic strips has a substantially hexagonal cross-sectional shape, with a first set of opposing sides sealed to respective sides of adjacent ones of the dielectric strips. A second and third set of opposing sides of the hexagonal-shaped metallic strips protrude into the interior of the waveguide with a taper.

SUMMARY OF THE INVENTION

An object of the present invention is to provide a vacuum output window for broadband high-power microwave use.

Another object of the present invention is to provide a vacuum output window that does not require brazing of its parts in fabrication.

Briefly, a vacuum output window of the present invention comprises a planar dielectric material with identical systems of parallel ridges and valleys formed in opposite surfaces. The valleys in each surface neck together along parallel lines in the bulk of the dielectric. Conduits are formed linearly along such lines of necking and have liquid coolant pumped through to remove heat. The dielectric material can be alumina or its crystalline form, sapphire. The E-field of an incident megawatt millimeter-wave radio frequency energy is oriented perpendicular to the system of ridges and valleys. The ridges, about one wavelength tall and with a period of about one wavelength, focus the incident energy through in ribbons that squeeze between the liquid-coolant conduits without significant losses over very broad bands of the radio spectrum. In an alternative embodiment, the liquid-coolant conduits are encased in metal within the bulk of the dielectric.

An advantage of the present invention is that a window is provided for operating at megawatt power levels with broadband millimeter wave energies.

Another advantage of the present invention is that a method is provided for fabrication a window suitable for operation at megawatt power levels with broadband millimeter wave energies.

A still further advantage of the present invention is that a window suitable for operation at broadband microwave megawatt power levels is provided without depending on vacuum-tight brazes between metal and dielectric strips.

An advantage of the present invention is that a window is provided that is practical to fabricate and simple to operate.

An advantage of the present invention is that a high-power broadband window is provided that does not depend on cryogens for cooling, and thus avoids troublesome pumping systems and cryogenic temperatures that can cause a window to sweat with moisture and ice.

DETAILED DESCRIPTION OF THE INVENTION

Figure 1:
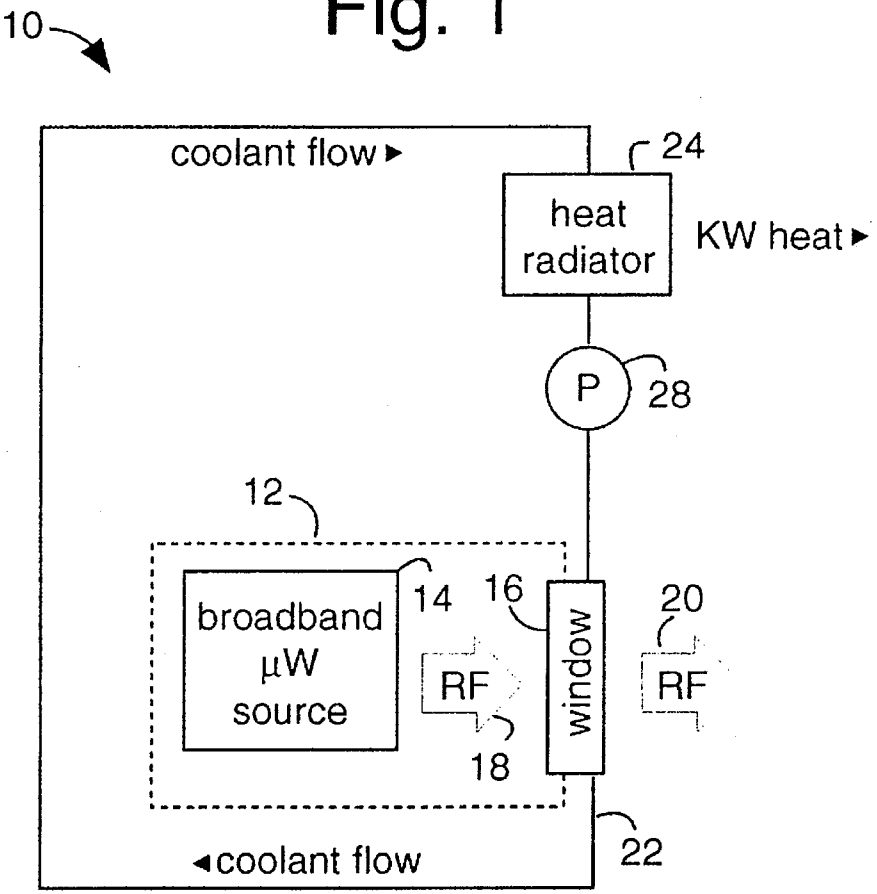
FIG. 1 is a functional block diagram of a broadband high-energy millimeter electromagnetic radiation source embodiment of the present invention.

FIG. 1 illustrates a millimeter-wave source 10, which comprises a microwave tube 12 with a free-electron generator 14 and a dielectric window 16 that helps contain a vacuum but allows a broadband high-energy millimeter electromagnetic radiation 18 to pass through as an output 20. The dielectric window 16 may comprise alumina or its crystalline form, sapphire. The heat conductivity of sapphire is generally better than its amorphous cousin alumina. The output power of the output 20 can reach a megawatt or more. The difference in power between radiation 18 and the output 20 is represented by heat that is deposited in the window 16. A piping 22 circulates a liquid coolant through a heat radiator 24 under pressure from a pump 28 back to the window 16. Water, under high pressure, is expected to be a suitable liquid coolant.

Figure 2:
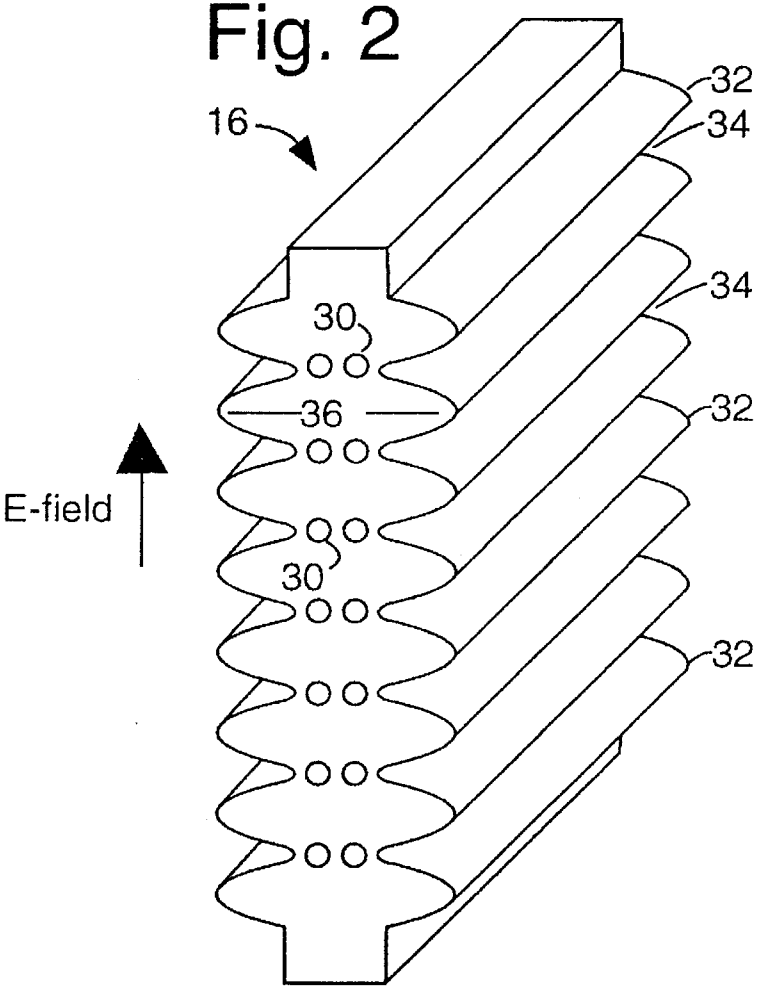
FIG. 2 is a perspective view of an all-dielectric vacuum output window embodiment of the present invention included in the source of FIG. 1.

FIG. 2 illustrates the window 16 in greater detail. A system of conduits 30 is embedded in the dielectric material of the window 16. The conduits 30 are positioned according to a system of parallel ridges 32 and valleys 34 in the surface of the dielectric material. The valleys 34 on opposite sides are aligned with one another, as are the ridges 32, e.g., to form a set of thick channels 36. It is critical to the present invention that the thick channels 36 comprise dielectric material. Alternatively, the conduits 30 may include in their population individual members that are in the thick channels 36, without adversely affecting the microwave propagation. The ridges 32 and valleys 34 may be disposed on only one surface of the window 16, but placement on both surfaces is preferred. Such ridges 32 and valleys 34 may be cast, molded or cut into the base material. The conduits 30 are positioned between the channels 36. The conduits 30 may be channeled out from one side and then capped or drilled from an outside edge. Millimeter-wave electromagnetic radiation is focused by the projections of the ridges 32 by a phenomenon akin to diffraction of light, and the energy concentrates into bands that transmit from one surface to the other along the channels 36. Such energy concentrated into bands passes to either side of each of the conduits 30. The projections of the ridges 32 can take on the cross sections of cones, triangles, sawtooth, elliptical or parabolic sections, etc. The whole is reminiscent of a Fresnel lens but at radio frequencies. Such projections of the ridges 32 are believed to support a broadband transmission through the channels 36.

Preferably, the depths between the tops of the ridges 32 and the bottoms of the valleys 34 on each surface are about the same as one another, and the depths are nominally equal to the wavelength of one of the frequencies included in the output 20, e.g., the mean frequency. Similarly, the distance between adjacent tops of the ridges 32 on one surface, and also the distance between adjacent bottoms of the valleys 34 on one surface, are all about the same and are nominally equal to the wavelength of one of the frequencies included in the output 20, e.g., the mean frequency. The distance along the channels 36 are also about the same as one another and equal to approximately four wavelengths of one of the frequencies included in the output 20. In one practical embodiment, the mean wavelength was two millimeters, and the overall window 16 was twenty centimeters square and averaged six millimeters thick. The grillwork of conduits 30 included at least fifty sets of individual parallel conduits.

Figure 3:
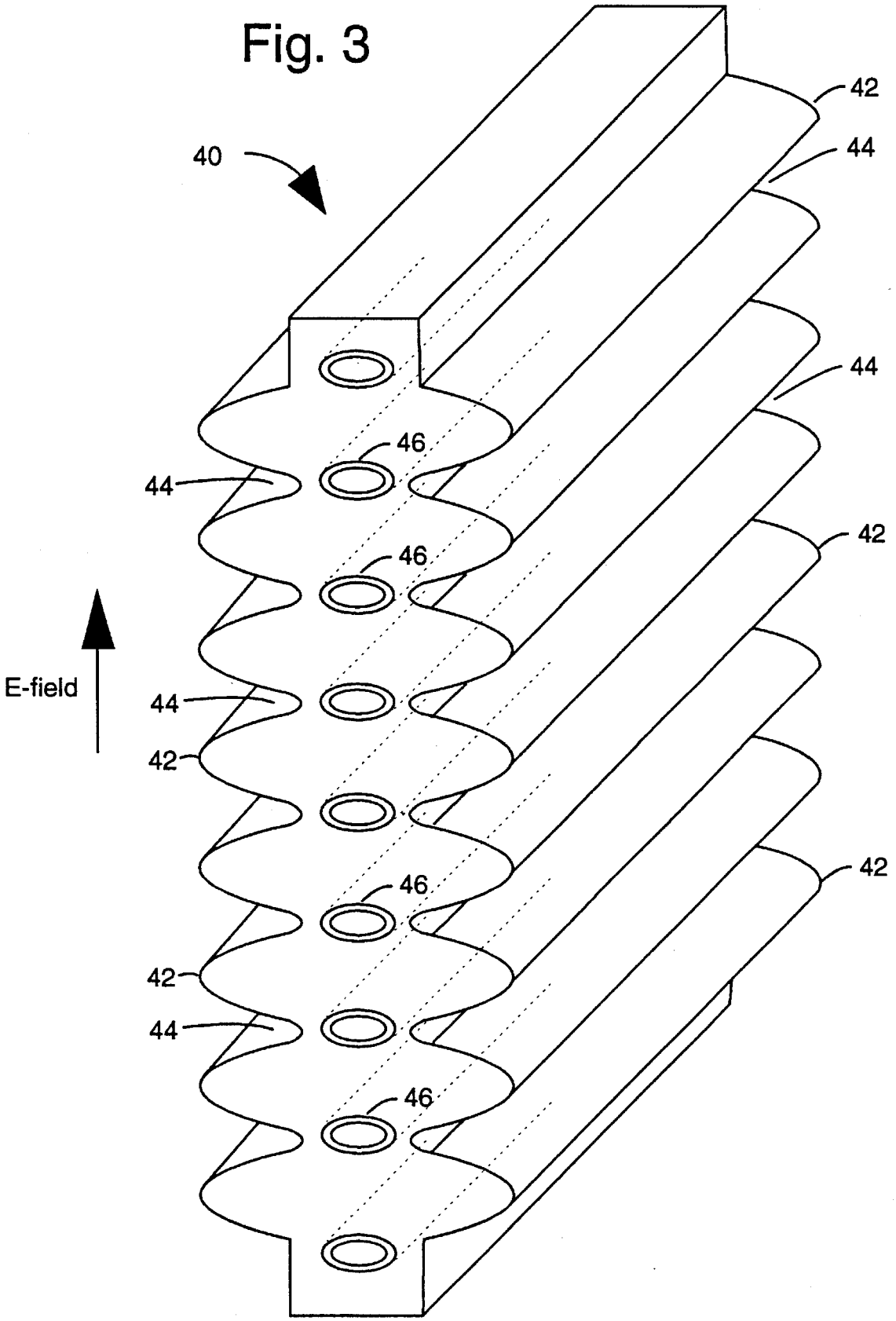
FIG. 3 is a perspective view of an alternative vacuum output window embodiment of the present invention with embedded metal casings that surround the liquid-coolant conduits aligned with the thinnest portions of the dielectric.

FIG. 3 illustrates a window 40 that is similar in purpose and function to the window 16. The window 40 comprises a solid piece of dielectric material, e.g., alumina or sapphire, having a system of parallel ridges 42 and valleys 44. Such ridges and valleys are uniform in their spacing and amplitude, which are preferably each about one wavelength in dimension for one frequency included in a broadband microwave energy. If both opposing surfaces of the window 40 have such systems of ridges 42 and valleys 44, then they must be co-aligned to have the valleys 44 neck together along parallel lines. A grillwork of metal-lined conduits 46 is provided in these necked-together linear areas to provide cooling. Any number of conventional chemical and beam etching technologies can be used to open up round or oval holes for such conduits. Once opened up, the conduits are lined with metal, e.g., copper by electroplating. In operation, microwave energy passing through the window 40 will be prevented from dispersing into the liquid-coolant pumped through the metal-lined conduits 46 by the metal lining. Such microwave energy passing through is theorized to be focused by each ridge 42 through the thickness of the window 40 along parallel ribbons that are concentrated in bands extending from ridge to ridge. The parallel ribbons of energy squeeze between the metal-lined conduits 46.

Figure 4:
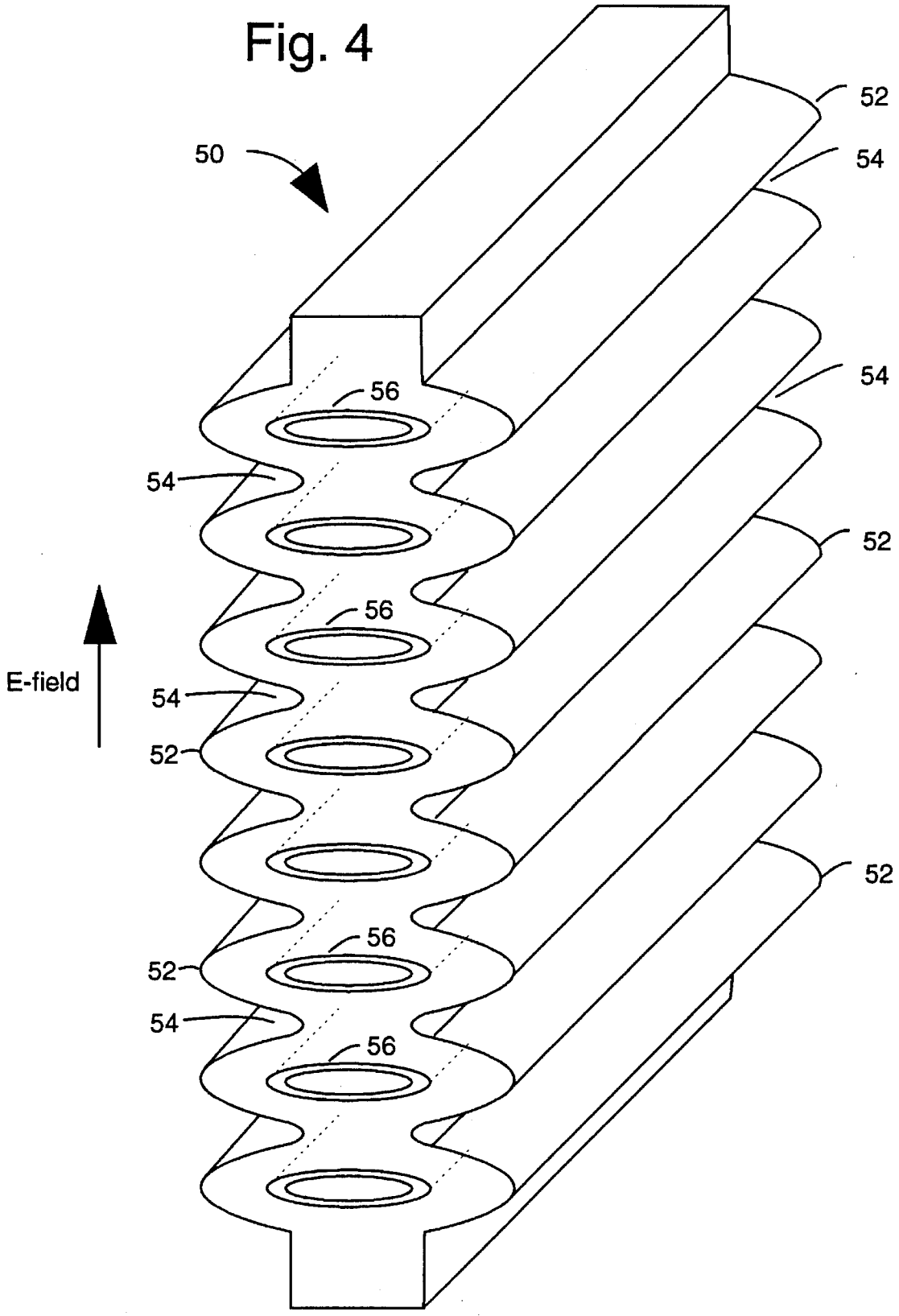
FIG. 4 is a perspective view of a second alternative vacuum output window embodiment of the present invention with embedded metal casings that surround the liquid-coolant conduits aligned with the thickest portions of the dielectric.

FIG. 4 illustrates a window 50 that is similar in purpose and function to the windows 16 and 40. The window 50 comprises a solid piece of dielectric material, e.g., alumina or sapphire, having a system of parallel ridges 52 and valleys 54. Such ridges and valleys are uniform in their spacing and amplitude, which are preferably each about one wavelength in dimension for one frequency included in a broadband microwave energy. For example, the mean frequency of the frequency band. If both opposing surfaces of the window 50 have such systems of ridges 52 and valleys 54, then they must be co-aligned to have the valleys 54 neck together along parallel lines. A grillwork of metal-lined conduits 56 is provided in the thickest linear areas between the opposite peaks of the ridges 52 to provide cooling. Any number of conventional chemical and beam etching technologies can be used to open up round or oval holes for such conduits. Once opened up, the conduits are lined with metal, e.g., copper by electroplating. In operation, microwave energy passing through the window 50 will be prevented from dispersing into the liquid-coolant pumped through the metal-lined conduits 56 by the metal lining. The microwave energy is theorized to pass through the thickness of the window 50 in parallel ribbons that skin along and are combed between the metal-lined conduits 56.

A first method for fabricating the vacuum output window 16 comprises cutting a system of parallel ridges and valleys in a planar dielectric substrate, e.g., sapphire, so that the depths of the valleys measured from the ridges are approximately the same and equal to at least one of the wavelengths included in a broadband radiation. The periods between adjacent valleys and the periods between adjacent ridges are preferably approximately the same and equal to at least one of the wavelengths included in the incident broadband radiation. Channels are opened in the planar dielectric substrate to run in parallel nearest to the valleys in the system of parallel ridges and valleys. The channels are then closed to form the liquid-coolant conduits 30.

A second method for fabricating the vacuum output window 16 comprises molding the system of parallel ridges and valleys 32 and 34 in alumina. Again, the depths of the valleys measured from the ridges are preferably about the same and equal to at least one of the wavelengths included in a broadband radiation. And, the periods between adjacent valleys and the periods between adjacent ridges are approximately the same and equal to at least one of the wavelengths included in the broadband radiation. The liquid-coolant conduits 30 are drilled to run in parallel nearest the valleys 34. The conduits 30 are gathered by the pipe 22 to support a flow of liquid-coolant.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A barrier window for passing through broadband high-energy radiation, comprising:

a planar dielectric material in the basic form of a window and having opposite first and second surfaces;

a system of parallel ridges and valleys disposed in at least one of said opposite first and second surfaces and formed of said planar dielectric material, wherein the depths of said valleys measured from said ridges are approximately the same and equal to at least one of the wavelengths included in a broadband radiation, and wherein the periods between adjacent valleys and the periods between adjacent ridges are approximately the same and equal to at least one of the wavelengths included in said broadband radiation; and a system of liquid-coolant conduits disposed in the planar dielectric material and oriented to run in parallel proximate to said valleys in the system of parallel ridges and valleys in the thinnest linear parts of the planar dielectric material.

2. The window of claim 1, wherein:

the system of parallel ridges and valleys is disposed in each of said first and second surfaces such that said valleys in each surface are aligned to be proximate to one another, and wherein said liquid-coolant conduits are included only in the volumes between said opposite valleys.

3. The window of claim 1, wherein:

the system of parallel ridges and valleys is set perpendicular to the electric-field orientation of said broadband radiation.

4. The window of claim 1, wherein:

the system of parallel ridges and valleys has a sawtooth cross section.

5. A barrier window for passing through broadband high-energy radiation, comprising:

a planar dielectric material in the basic form of a window and having opposite first and second surfaces;

a system of parallel ridges and valleys disposed in each of said opposite first and second surfaces and formed of said planar dielectric material such that said valleys in each surface are aligned to be proximate to one another, and wherein the depths of said valleys measured from said ridges are approximately the same and equal to at least one of the wavelengths included in a broadband radiation, and wherein the periods between adjacent valleys and the periods between adjacent ridges are approximately the same and equal to at least one of the wavelengths included in said broadband radiation;

a system of liquid-coolant conduits disposed in the planar dielectric material and oriented to run in parallel proximate to said valleys in the system of parallel ridges and valleys, wherein said liquid-coolant conduits are included only in the volumes between said opposite valleys; and a pressurized water flow in the system of liquid-coolant conduits.

6. A broadband high-energy millimeter electromagnetic radiation source, comprising:

a free-electron microwave source;

a vacuum in which the free-electron microwave source is disposed;

a dielectric planar window positioned relative to the free-electron microwave source and the vacuum to bar atmospheric pressure and providing for a polarized output of broadband electromagnetic radiation;

a system of parallel ridges and valleys disposed in a surface of the planar dielectric window, wherein the depths of said valleys measured from said ridges are approximately the same and equal to at least one of the wavelengths included in said broadband electromagnetic radiation, and wherein the periods between adjacent valleys and the periods between adjacent ridges are approximately the same and equal to at least one of the wavelengths included in said broadband electromagnetic radiation;

a grillwork of liquid-coolant conduits disposed in the planar dielectric window and oriented to run in parallel proximate to said valleys in the system of parallel ridges and valleys; and a liquid-coolant circulation system connected to the grillwork of liquid-coolant conduits and providing for the removal of heat dumped in the dielectric planar window caused by said broadband electromagnetic radiation passing through.

7. A method for fabricating a vacuum output window, the method comprising the steps of:

cutting a system of parallel ridges and valleys in a planar dielectric substrate, wherein the depths of said valleys measured from said ridges are approximately the same and equal to at least one of the wavelengths included in a broadband radiation, and wherein the periods between adjacent valleys and the periods between adjacent ridges are approximately the same and equal to at least one of the wavelengths included in said broadband radiation;

opening up channels in said planar dielectric substrate oriented to run in parallel proximate to said valleys in said system of parallel ridges and valleys; and closing said channels to form a system of liquid-coolant conduits disposed in the planar dielectric material.

8. A method for fabricating a vacuum output window, the method comprising the steps of:

molding a system of parallel ridges and valleys in a planar dielectric substrate, wherein the depths of said valleys measured from said ridges are approximately the same and equal to at least one of the wavelengths included in a broadband radiation, and wherein the periods between adjacent valleys and the periods between adjacent ridges are approximately the same and equal to at least one of the wavelengths included in said broadband radiation;

drilling a system of liquid-coolant conduits in said planar dielectric substrate oriented to run in parallel proximate to said valleys in said system of parallel ridges and valleys; and collecting said system of liquid-coolant conduits to support a flow of pressurized water.

* * * * *